US008939021B2

(12) United States Patent
Daniel et al.

(10) Patent No.: US 8,939,021 B2
(45) Date of Patent: Jan. 27, 2015

(54) FLUID EXPANSION IN MUD GAS LOGGING

(75) Inventors: Pierre J. Daniel, Missouri City, TX (US); Stefan Smuk, Houston, TX (US); Reza Taherian, Sugar Land, TX (US); Julian J. Pop, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 737 days.

(21) Appl. No.: 13/127,772

(22) PCT Filed: Nov. 17, 2009

(86) PCT No.: PCT/US2009/064735

§ 371 (c)(1), (2), (4) Date: Sep. 21, 2011

(87) PCT Pub. No.: WO2010/059601

PCT Pub. Date: May 27, 2010

(65) Prior Publication Data

US 2012/0000279 A1 Jan. 5, 2012

Related U.S. Application Data

(60) Provisional application No. 61/115,786, filed on Nov. 18, 2008.

(51) Int. Cl.

| | |
|---|---|
| ***E21B 47/00*** | (2012.01) |
| ***E21B 49/10*** | (2006.01) |
| *E21B 49/08* | (2006.01) |

(52) U.S. Cl.

CPC ..... *E21B 49/10* (2013.01); *E21B 2049/085* (2013.01)

USPC ..... 73/152.04

(58) Field of Classification Search

USPC ..... 73/152.04

See application file for complete search history.

(56) References Cited

U.S. PATENT DOCUMENTS

| | | | | |
|---|---|---|---|---|
| 4,370,886 | A | 2/1983 | Smith et al. | |
| 4,756,836 | A * | 7/1988 | Jeffrey et al. | 210/750 |
| 4,961,343 | A * | 10/1990 | Boone | 73/152.03 |
| 5,329,811 | A | 7/1994 | Schultz et al. | |
| 6,627,873 | B2 | 9/2003 | Tchakarov et al. | |
| 6,939,717 | B2 | 9/2005 | Jiang et al. | |
| 7,210,342 | B1 * | 5/2007 | Sterner et al. | 73/152.18 |
| 7,458,257 | B2 * | 12/2008 | Pop et al. | 73/152.04 |
| 7,752,906 | B2 * | 7/2010 | Pop et al. | 73/152.04 |
| 8,056,408 | B2 * | 11/2011 | Pop et al. | 73/152.04 |
| 8,061,444 | B2 * | 11/2011 | Mullins et al. | 175/50 |

(Continued)

FOREIGN PATENT DOCUMENTS

| | | | |
|---|---|---|---|
| EP | 128071 | A * | 12/1984 |
| GB | 2198054 | A * | 6/1988 |

OTHER PUBLICATIONS

International Search Report & Written Opinion issued in PCT/US2009/064735 on Jul. 12, 2010; 2 pages.

*Primary Examiner* — John Fitzgerald

(74) *Attorney, Agent, or Firm* — Kenneth L. Kincaid; Cathy Hewitt

(57) ABSTRACT

Apparatus and methods for fluid expansion in mud gas logging to determine downhole the composition of a downhole hydrocarbon fluid sample by expanding the sample using an incrementally adjustable piston or a series of fixed chambers to extract vapor containing composition components of interest.

13 Claims, 11 Drawing Sheets

(56) References Cited

U.S. PATENT DOCUMENTS

| | | | | |
|---|---|---|---|---|
| 8,082,780 | B2 * | 12/2011 | Vannuffelen et al. | 73/152.27 |
| 8,528,396 | B2 * | 9/2013 | Wu et al. | 73/152.55 |
| 2005/0176034 | A1 * | 8/2005 | Peeters et al. | 435/6 |
| 2007/0137293 | A1 * | 6/2007 | Pop et al. | 73/152.23 |
| 2008/0110253 | A1 * | 5/2008 | Stephenson et al. | 73/152.19 |
| 2009/0049889 | A1 * | 2/2009 | Pop et al. | 73/19.09 |
| 2009/0050369 | A1 * | 2/2009 | Pop et al. | 175/42 |
| 2009/0288881 | A1 * | 11/2009 | Mullins et al. | 175/50 |
| 2010/0050760 | A1 * | 3/2010 | Vannuffelen et al. | 73/152.27 |
| 2010/0192684 | A1 * | 8/2010 | Wu et al. | 73/152.55 |
| 2011/0084202 | A1 * | 4/2011 | Finlay | 250/254 |
| 2011/0088895 | A1 * | 4/2011 | Pop et al. | 166/254.2 |
| 2011/0189778 | A1 * | 8/2011 | Daniel et al. | 436/25 |

* cited by examiner

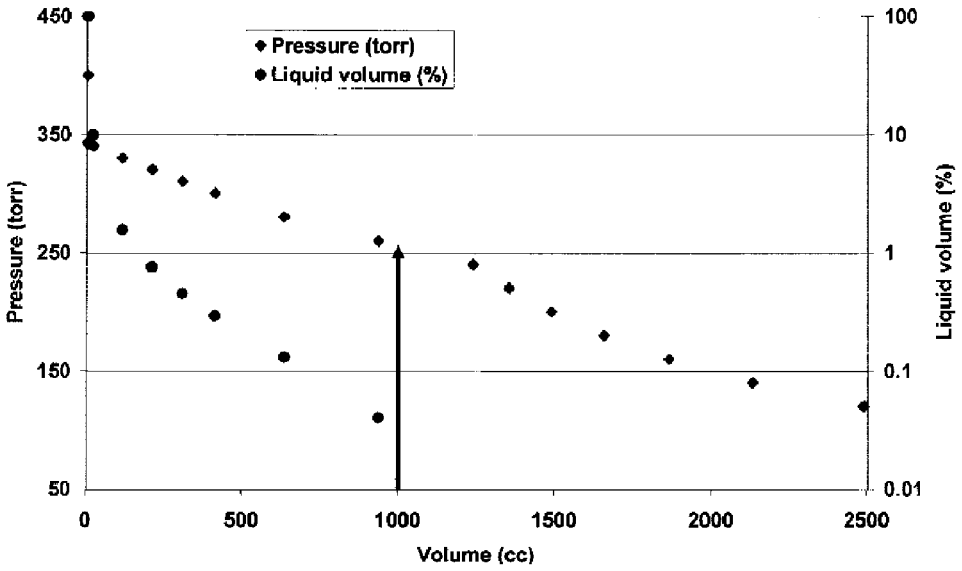
*Fig. 4: Piston Expansion of a Binary Mixture*
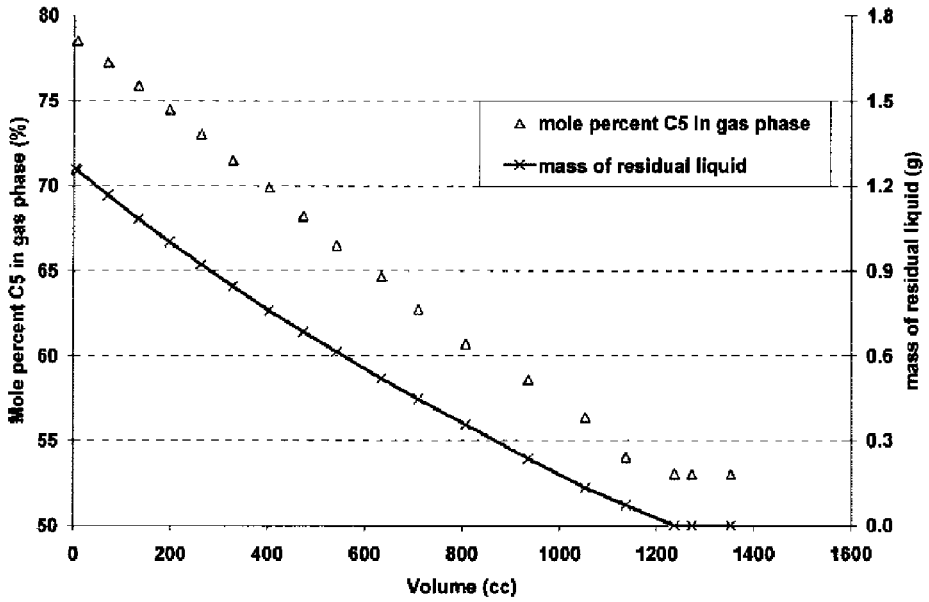
*Fig. 5: Mole Percent vs. Volume*

FLUID EXPANSION IN MUD GAS LOGGING

REFERENCE TO RELATED APPLICATIONS

The present application claims the benefit of the earlier filing date of U.S. Provisional Application No. 61/115,786, entitled "Fluid Expansion in Mud Gas Logging," filed Nov. 18, 2008, the entire disclosure of which is hereby incorporated by reference.

BACKGROUND OF THE DISCLOSURE

In downhole mud gas logging (DHMGL) applications, a sample is extracted from the drilling fluid close to the drill bit. The drilling process breaks and grinds the rock formation, releasing the formation fluid into the drilling mud. The components of interest in the formation fluid for DHMGL may include hydrocarbons (including gas and liquid), water, N2, H2S, and CO2. The hydrocarbons are usually in the range of C1 to above C30, but DHMGL is mainly concerned with hydrocarbons in the range of C1 to C8 or C10. These hydrocarbons must be vaporized in order to isolate them, in order to measure their concentrations using methods such as mass spectrometry (MS).

SUMMARY OF THE DISCLOSURE

The present disclosure introduces methods and apparatus configured to perform the above-described vaporization, including how to vaporize a sample and how to manage high-concentration components that limit the resolution of other components.

For example, the present disclosure introduces a method which may be employed to measure the composition of a downhole hydrocarbon-fluid sample by expanding the sample using a piston, or a series of multiple fixed chambers, to extract vapor containing components of interest.

The present disclosure also introduces a method which may be employed to measure the composition of a downhole hydrocarbon-fluid sample under downhole conditions (using expansion).

The present disclosure also introduces a method which may be employed to concentrate selected components of the composition of a downhole hydrocarbon-fluid sample, and subsequently measure their relative concentrations.

The present disclosure also introduces a downhole apparatus which may be employed to vaporize a sample using a piston.

The present disclosure also introduces a downhole apparatus which may be employed to vaporize a sample using one or more expansion chambers having fixed volumes.

The present disclosure also introduces a downhole apparatus which may be employed to vaporize a sample using multiple expansion chambers and a pressure reduction chamber.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 4 is a graph demonstrating one or more aspects of the present disclosure.

FIG. 5 is a graph demonstrating one or more aspects of the present disclosure.

DETAILED DESCRIPTION

Figure 1:
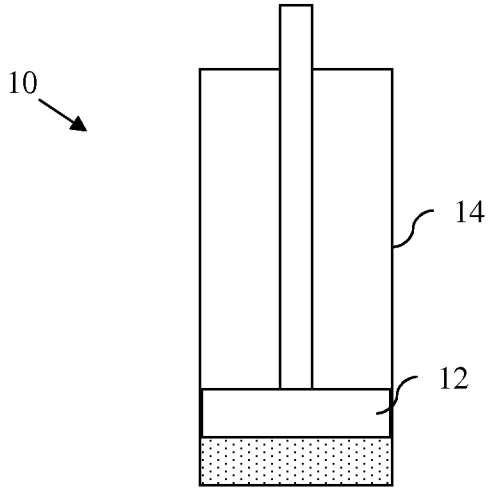
FIG. 1 is a schematic view of at least a portion of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Liquid samples can be expanded by using a cylinder and piston, or by fixed volume chambers. A cylinder/piston arrangement 10 as schematically shown in FIG. 1 may be employed to expand the volume incrementally from zero up to a maximum volume. At each incremental volume, a portion of the initial pressurized fluid transforms to gas and exerts a pressure on the piston 12. As a result, the liquid volume reduces. There is a relationship between the composition of the gas in the cylinder 14 and the component concentrations in the liquid sample, as discussed in more detail below.

Figure 2:
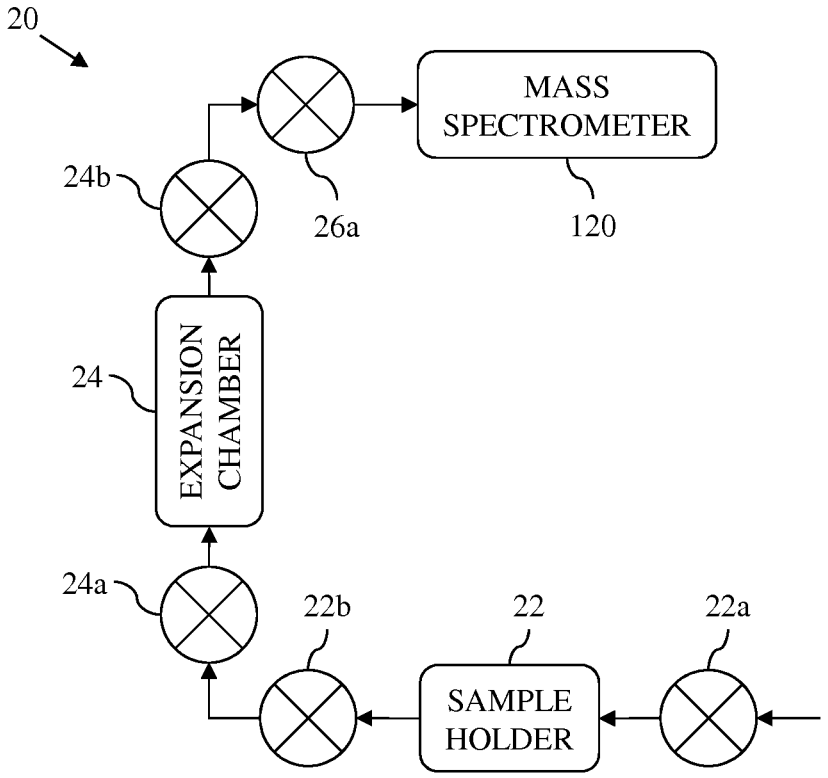
FIG. 2 is a schematic view of at least a portion of an apparatus according to one or more aspects of the present disclosure.

Fixed volume chamber expansion is another method which may be employed, and in some implementations may be more appropriate for downhole environments. FIG. 2 is a schematic view of an example apparatus 20 which may be employed to expand a liquid sample into a fixed volume. The sample fills a relatively small sample holder 22 which may have a volume of about 1-2 cc. The sample may be a multi-component fluid mixture containing dissolved solution-gas. The process of filling the sample holder 22 may be configured such that the entire volume of the sample holder 22 is filled with liquid. As such, the volume of the sample may be accurately known from a single calibration of the volume of the sample holder 22. This filling can be performed, for example, by flowing sample through the sample holder 22 via operation of an input valve 22*a* and an output valve 22*b*. Closing these two valves 22*a* and 22*b* may therefore trap a known volume of sample.

As shown in FIG. 2, an expansion chamber 24 is connected to the sample holder 22 through an input valve 24*a*. While the input valve 24*a* is closed, the chamber 24 is evacuated. Expansion takes place when an output valve 24*b* is closed and input valve 24*a* is opened, thereby connecting the liquid sample in the sample holder 22 to the empty volume of the expansion chamber 24. As with cylinder/piston embodiment described above, some components in the liquid expand and fill the expansion chamber 24, reducing the volume and changing the composition of liquid. Since the volume of the expansion chamber 24 is fixed, the volatile components in the sample fill the chamber 24 and generate a pressure P1, which is a function of sample composition, chamber volume, and temperature. In addition, the composition of the vaporized phase depends on the composition of the original sample. These two compositions are related, as described below.

Figure 3:
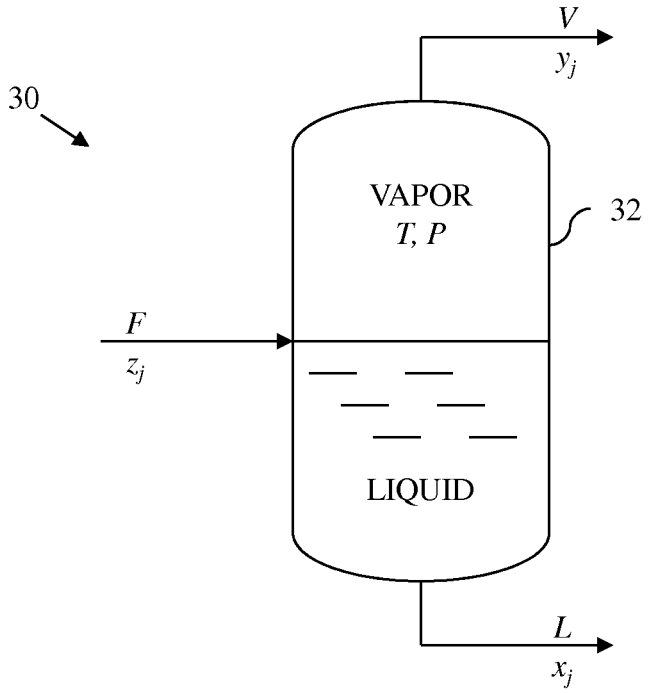
FIG. 3 is a schematic view of at least a portion of an apparatus according to one or more aspects of the present disclosure.

The expansion which occurs in the expansion chamber 24 is called flash or partial separation, and is the partial vaporization that occurs when a liquid undergoes a reduction in pressure by passing through a pressure and temperature flash cell 30 as shown in the exemplary schematic view of FIG. 3. In the illustrated schematic, the sample to undergo the pressure reduction is called the feed F with its mole fractions $z_j$, L is the liquid left in the reservoir 32 with its mole fractions $x_j$, and V is the portion evaporated with its mole fractions $y_j$.

In the case of a single-compound liquid in the feed line, part of the liquid immediately "flashes" into vapor. Both the vapor and the residual liquid are cooled to the saturation temperature of the liquid at the reduced pressure. If the saturated liquid is a multi-component liquid, the flashed vapor is richer in the more volatile components than is the remaining liquid.

The following discussion considers the expansion of a single hydrocarbon, a mixture of liquid hydrocarbons, and a crude oil sample in which gas is dissolved in a liquid sample.

If the sample is a single hydrocarbon (e.g., pentane), the expansion is simple. As the empty volume of the reservoir 32 becomes available to the sample, a portion of the liquid transforms into gas and fills up the volume. At a given temperature (below the boiling point), the pressure of the gas phase portion of the sample equals the vapor pressure of the liquid, which is a function of temperature and is well known. If the volume of the reservoir 32 is large enough that all of the liquid of the sample must vaporize to maintain the vapor pressure, then there would be no liquid left. If the volume of the reservoir 32 is even larger, all of the liquid will be evaporated and the pressure will be lower than the vapor pressure of the compound. In this case, the measurement of the sample pressure P1, sample volume V1, and sample temperature T along with an equation of state such as PV=nRT would lead to direct measurement of the number of moles in the gas phase and thus the amount of the liquid sample. For example, pentane has a density of 0.62139 g/cc at room temperature, and 1 cc of liquid contains $8.612\times10^{-3}$ moles of pentane that expand to 303 cc of gas at 512.2333 torr. Therefore, the expansion volume of the chamber (or piston) must be at least 303 cc for complete vaporization.

The equilibrium flash of a multi-component liquid into a volume is different and more complex than the flashing of a single component liquid. For a multi-component liquid, calculating the amounts of flashed vapor and residual liquid in equilibrium with each other at a given temperature and pressure requires an iterative approach. Such a calculation is commonly referred to as an equilibrium flash calculation. It involves solving the following Rachford Rice equation:

$$\Sigma_i[z_i(K_i-1)]/[1+a(K_i-1)]=0.$$

Here, i refers to a component in the mixture and the remaining terms are defined in Table 1 below. Also available is the overall balance equation F=V+L, and the material balance equation for any compound i, $Fz_i=Vy_i+Lx_i$. The equation defining the vapor liquid equilibrium constant is: $K_i=y_i/x_i$, with the following equation parameters:

TABLE 1

| | |
|---|---|
| F | Moles of total feed liquid |
| V | Moles of flashed vapor |
| a | Fraction of feed that is vaporized = V/F |
| L | Moles of residual liquid |
| $K_i$ | Equilibrium constant |
| $x_i$ | Moles fraction of compound i in the feed liquid |
| $y_i$ | Moles fraction of compound i in the flashed vapor |
| $x_i$ | Moles fraction compound i in the residual liquid |

An equation of state is used to solve Rachford Rice equation. One such equation of state is the Robinson-Peng equation shown in Table 2 below.

TABLE 2

| | |
|---|---|
| $p = [(RT)/(V_m - b)] - [a\alpha/((V_m)^2 + 2bV_m - b^2)]$ | $T_r = T/T_c$ |
| $\alpha = (1 + (0.37464 + 1.54226\omega - 0.26992\omega^2)(1 - (T_r)^{0.5}))^2$ | |
| $a = 0.45724R^2(T_c)^2/p_c$ | $b = 0.07780RT_c/p_c$ |

Note that ω is the acentric factor which accounts for characteristic of the molecular structure of the species.

In the limit of low pressure ("ideal solution"), the composition dependency of k-values weakens, and can be considered as predominantly a function of component vapor pressures. Ideal-solution concepts are described further below.

Regarding piston expansion of a binary liquid mixture, a simulation has been done with a pentane-hexane (c5-C6) liquid mixture in the feed line with a pentane mole fraction 0.53 and hexane mole fraction of 0.47 in the liquid phase. For a piston expansion, the initial vaporization leads to a gas phase mixture of 78.2 mole percent pentane (21.8 mole percent hexane). To do this calculation, Raoult's law can be used as a first approximation:

$$P_{tot} = \sum_{i=1}^{n} x_i P_i^0$$

where $P_{tot}$ is the vapor pressure of the mixture and is the weighted sum of individual vapor pressures. Note that there is an approximation that pressures can be used in place of fugacities. The weighting factor is the mole fraction of individual component in the liquid. The mole fractions in the gas phase can be calculated using:

$$y_i = \frac{x_i P_i^0(T)}{P_{tot}}$$

This expression clearly demonstrates that the mole fractions in the liquid and gas phase are not the same unless there is only one component in the mixture (pure liquid, discussed above).

As the gas volume increases due to further expansion, more molecules evaporate at a rate that is proportional to the instantaneous mole fraction and the vapor pressure of each compound. As the expansion continues, the composition of both liquid and gas changes until eventually all liquid is vaporized. FIG. 4 is a graph demonstrating how the gas pressure decreases as a result of expansion. FIG. 4 also demonstrates how the liquid volume decreases and eventually goes to zero at high expansion volumes.

FIG. 5 is a graph demonstrating how the mole percent of pentane varies with expansion volume. Note that, before any expansion, there is no gas phase and the pentane mole percent is zero. As soon as free volume is provided to the liquid, the pentane mole fraction jumps to 80%, which is larger than its concentration in the liquid phase. As the expansion continues, the pentane mole percent decreases and approaches the concentration in the liquid phase. Hexane, on the other hand, starts with smaller mole percent in the gas compared to liquid phase, and increases to the initial feed mole percent.

When the liquid is totally consumed, the mole fractions in the gas are the same as the liquid's starting mole fractions. Raoult's law governs while both liquid and gas phases are present. Once all of the liquid is evaporated (at total vaporization), an equation of state governs. At very low pressures, the ideal gas law applies specifically (i.e., PV=nRT). Thus, with further expansion past the total vaporization point, the pressure is inversely proportional to the volume.

As FIG. 4 shows, a piston expansion with enough range can be used to evaporate the entire liquid, at which point pressure P and volume V are measured and the total number of moles is calculated. When the entire volume of liquid is evaporated, individual mole fractions can be measured using a mass spectrometer, for example. These mole fractions are the same as the mole fractions in the liquid prior to expansion. Note that, in addition to these measurements, the density of the liquid should be known or measured to convert liquid volume to mass. The techniques for measuring liquid density uphole or downhole are well known in the art.

Alternatively, the mole fractions of gas mixture still in equilibrium with liquid can be measured, using a mass spectrometer for example. This data can be used to solve for the liquid-phase mole fractions of the measured components, using literature of ideal-solution k-values. Again, the density of the liquid is required to resolve the entire (mass-based) compositional distribution of the system. This method works with either piston expansion or chamber expansion, as discussed below.

Regarding chamber expansion of a binary liquid mixture, FIG. 4 also shows that the pentane-hexane mixture has to be expanded to more than 1200 cc for all liquid to be vaporized. However, one can also consider chamber expansion wherein a much smaller expansion volume is used. As an example, consider the scenario in which the same pentane-hexane mixture is expanded into a 100 cc expansion chamber. A simulation can be performed using the same initial conditions as above: 2 cc of pentane-hexane mixture with mole fraction 53%-47%, initial pressure of 400 torr, initial temperature of 25° C., and initial mass of 1.259 grams. Table 3 below summarizes the results.

TABLE 3

| Component | MW g/mol | Feed mole % | Liquid mole % | Vapor mole % | K value |
|---|---|---|---|---|---|
| n-C5 | 72.15 | 53 | 50.05 | 76.54 | 1.53 |
| C6 | 84 | 47 | 49.95 | 23.46 | 0.47 |

From an initial pressure of 400 torr at 25° C., the pressure is reduced to 331.3 torr and the volume of molecules in gas phase is 100 cc at 25° C. Under these conditions, the pentane and hexane mole fractions in gas phase are respectively 76.54% and 26.46%. The mass in weight percent amounts to 73.66% for pentane and 26.34% for hexane in gas phase. The individual masses of pentane and hexane are respectively 0.100 g and 0.036 g in the gas phase, and the mass of the residual liquid is 1.123 g.

The results listed in Table 3 show that it is possible to expand in a smaller volume, measure the individual components in the gas phase, and use the Rachford Rice equation to determine the concentrations in the initial liquid. The latter step may involve iterative inversion software, which may include a well known approach.

To show the effect of higher vapor pressures encountered at higher temperatures, an expansion simulation was done with different initial conditions: 2 cc of pentane and hexane mixture with a mole fraction of 53%-47%, initial pressure of 5000 torr, initial temperature of 100° C., and initial mass of 1.098 grams. These parameters are closer to oilfield conditions. Table 4 below shows the liquid and gas mole fractions for expansion volume of only 26 cc. These results show even smaller expansion chambers are feasible, which makes the instrumentation simpler.

TABLE 4

| Component | MW g/mol | Feed mole % | Liquid mole % | Vapor mole % | K value |
|---|---|---|---|---|---|
| n-C5 | 72.15 | 53.00 | 48.07 | 66.63 | 1.39 |
| C6 | 84.00 | 47.00 | 51.93 | 33.37 | 0.64 |

Now consider crude oil as a liquid sample with dissolved gases therein. Table 5 below, from SPE 54005, lists the different constituents of a real crude oil sample with hydrocarbons up to C20+. Regarding the expansion of such a sample, the initial sample pressure is the reservoir pressure and is equal to 6000 psia, the temperature is 248° F. (120° C.), and the sample has an initial mass of 1.024 g and a liquid volume of 2 cc.

TABLE 5

| Component | MW lb/lbmol | Density lb/ft$^3$ | Reservoir Fluid mole % |
|---|---|---|---|
| N2 | 28.014 | | 0.739 |
| CO2 | 44.01 | | 0.623 |
| C1 | 16.043 | | 65.105 |
| C2 | 30.07 | | 8.134 |
| C3 | 44.096 | | 3.892 |
| i-C4 | 58.123 | | 1.163 |
| n-C4 | 58.123 | | 1.718 |
| i-C5 | 72.15 | 38.476 | 0.650 |
| n-C5 | 72.15 | 38.814 | 0.683 |

TABLE 5-continued

| Component | MW lb/lbmol | Density lb/ft$^3$ | Reservoir Fluid mole % |
|---|---|---|---|
| C6 | 84 | 42.763 | 0.930 |
| C7 | 96 | 45.073 | 1.451 |
| C8 | 107 | 46.509 | 2.010 |
| C9 | 121 | 47.695 | 1.386 |
| C10 | 134 | 48.569 | 1.110 |
| C11 | 147 | 49.256 | 1.534 |
| C12 | 161 | 49.942 | 1.264 |
| C13 | 175 | 50.629 | 1.296 |
| C14 | 190 | 51.316 | 1.171 |
| C15 | 206 | 51.940 | 0.695 |
| C16 | 222 | 52.377 | 0.658 |
| C17 | 237 | 52.876 | 0.459 |
| C18 | 251 | 53.189 | 0.351 |
| C19 | 263 | 53.501 | 0.300 |
| C20+ | 380 | 59.900 | 2.678 |

Note the dominance of C1 (methane) and to a lesser extent C2 (ethane) and C3 (propane) in the composition. This distribution is typical of crude oil samples. The abundance of C1 makes it relatively difficult to measure the remaining components with good accuracy.

For simulation, initial temperature is at 120° C. and initial pressure is 6000 psia. The sample will initially be in a liquid phase, and as soon as it is connected to an expansion chamber it will evaporate. Table 6 below shows liquid and vapor mole fractions after an expansion into a chamber of only 23.84 cc. The pressure drops from 6000 psia to 324.4 psia at 120° C. and a gas volume of 23.84 cc is generated by vaporization of the liquid under analysis. At that point, the mass of residual liquid is 0.6359 g.

TABLE 6

| Component | Feed mole % | Liquid mole % | Vapor mole % | # of moles |
|---|---|---|---|---|
| N2 | 0.74 | 0.03 | 0..89 | 1.5E−04 |
| CO2 | 0.62 | 0.08 | 0.74 | 1.3E−04 |
| C1 | 65.11 | 5.48 | 78.04 | 1.3E−02 |
| C2 | 8.13 | 1.98 | 9.47 | 1.6E−03 |
| C3 | 3.89 | 1.97 | 4.31 | 7.3E−04 |
| i-C4 | 1.16 | 0.96 | 1.21 | 2.0E−04 |
| n-C4 | 1.72 | 1.71 | 1.72 | 2.9E−04 |
| i-C5 | 0.65 | 1.00 | 0.57 | 9.7E−05 |
| n-C5 | 0.68 | 1.19 | 0.57 | 9.7E−05 |
| C6 | 0.93 | 2.47 | 0.60 | 1.0E−04 |
| C7 | 1.45 | 5.23 | 0.63 | 1.1E−04 |
| C8 | 2.01 | 8.43 | 0.62 | 1.0E−04 |
| C9 | 1.39 | 6.55 | 0.27 | 4.5E−05 |
| C10 | 1.11 | 5.61 | 0.13 | 2.3E−05 |
| C11 | 1.53 | 8.07 | 0.12 | 2.0E−05 |
| C12 | 1.26 | 6.83 | 0.06 | 9.6E−06 |
| C13 | 1.30 | 7.11 | 0.03 | 5.8E−06 |
| C14 | 1.17 | 6.49 | 0.02 | 2.9E−06 |
| C15 | 0.70 | 3.87 | 0.01 | 9.3E−07 |
| C16 | 0.66 | 3.68 | 0.00 | 4.8E−07 |
| C17 | 0.46 | 2.57 | 0.00 | 1.8E−07 |
| C18 | 0.35 | 1.97 | 0.00 | 8.1E−08 |
| C19 | 0.30 | 1.68 | 0.00 | 4.3E−08 |
| C20 | 2.68 | 15.03 | 0.00 | 1.5E−09 |

Figure 6:
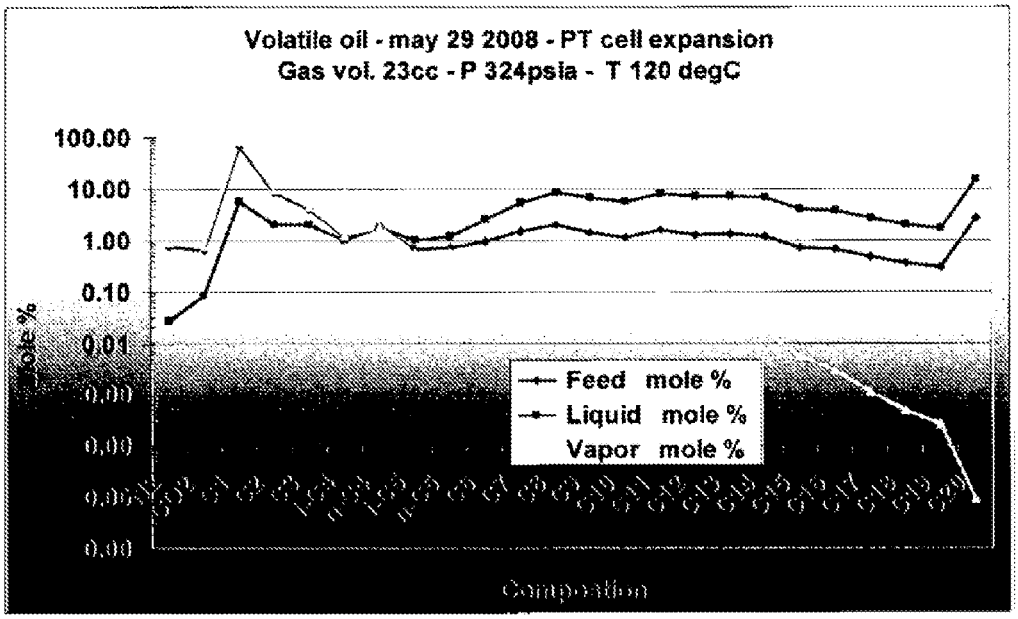
FIG. 6 is a graph demonstrating one or more aspects of the present disclosure.

The concentration of C1 in the liquid phase before and after expansion has reduced by more than 10 fold. Furthermore, C1 is the dominant component in the gas phase. For the first seven entries in Table 6, the liquid concentration has decreased, while for the remaining components the concentration has increased. These results are graphically shown in FIG. 6.

Assuming a measurement system, such as a mass spectrometer, with an arbitrarily set measurement accuracy of 1%, it would be possible to measure the vapor-phase C1-to-C4 distribution from the expansion. The remaining components would not be measurable using such a system. The vaporized components by themselves can be expressed in terms of a normalized mass and/or molar distribution. The proportions of the vapor components remaining in the liquid phase, as well as components too non-volatile to appear in the gas phase except at high dilution (C5+ in this example), can be combined and reported as a "lumped" fraction by mass balance. Then, we can derive a means to compute a compositional distribution of the whole feed, as follows.

Since the density and volume of the initial feed are known, the initial mass of the feed can be determined. The mass of the vapor phase is computed from the composition and the ideal-gas law, PV=nRT. The moles of the vapor system can be written $n=m_g/M_g$, where $m_g$=gas mass and $M_g$=molecular weight. $M_g$ is derived from the composition and component molecular weights, $M_g=\Sigma y_i M_i$, thus $m_g=Pv(\Sigma y_i M_i)/(RT)$.

Then, a mass balance can be computed, i.e., "initial feed-mass" minus "cumulative mass of vapor produced" equals "mass of the remaining residue". We now consider how to deconvolute the C1 through C4 in the liquid from the C5+ in order to obtain a feed composition.

The molar fractions of the components remaining in the liquid phase (C1 to C4, in this example) can be determined from calculated k-values if pressure is sufficiently low. In the limit of ideal-solution behavior, $k_i=Pv_i/P$, where $Pv_i$ is the individual-component vapor pressure, which in turn is a function only of temperature. To illustrate, let i=all measured components in the vapor phase (e.g., C1 through nC4), and C+=the undifferentiated "plus fraction" (e.g., C5+). Then:

All $y_i$=known (measured) and $y_{C+}\approx 0$;

$x_i=y_i/k_i$, where $k_i$ is obtained from literature values;

$x_{C+}=(1-\Sigma x_i)$.

It should be noted that to obtain the molar composition of the entire feed stream, one must obtain measurement, estimation, or correlation of the molecular weight of the whole fluid or the residue. Thus, the feed composition in its entirety is not accurately obtainable a-priori in this method. However, sufficiently extensive vaporization of components, combined with good resolution in the compositional-analysis method, would give a normalized distribution with sufficient accuracy and detail to be of value.

In mass terms, the process accurately produces a compositional distribution of the original feed, up to a limit. The limit is defined by the identity of the heaviest "fully" vaporized component, i.e., the heaviest component measured in the gas phase for which it can be accurately estimated that $y_i/k_i\approx 0$ at flash conditions. The mass of all components that are less volatile than the limiting compound, in the vapor phase, can be estimated from compositional data and the ideal-gas law. The mass of liquid residue, determined by overall mass balance, would by definition consist of only the plus-fraction components. (The designation of "full" vaporization is, in thermodynamic terms, an approximation, and would conform to some imposed specification, e.g., $x_i<0.01$).

In many cases, a single expansion in a practicable expansion apparatus might not vaporize enough components to an extent sufficient to give enough useful compositional information. In the given example, at the temperature and pressure of flashing, an overall mass composition could not be determined because none of the components of interest are fully vaporized. The present disclosure introduces the concept of a multi-stage expansion to address this issue, as well as the issue of analytical resolution due to dilution.

Figure 7:
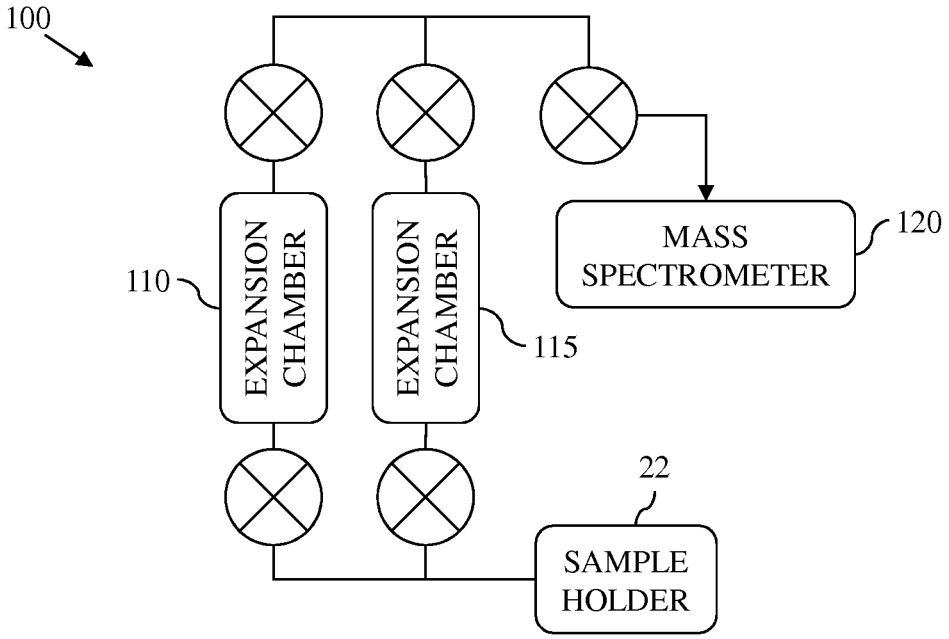
FIG. 7 is a schematic view of at least a portion of an apparatus according to one or more aspects of the present disclosure.

Table 6 above demonstrates how the chamber expansion primarily decreases the concentration of the most volatile and most abundant species. The ratio of C1/C6, for example, has changed from 70 prior to expansion to 2.2 after the first expansion. This suggests that the liquid can be expanded into a second evacuated chamber to further enhance the relative concentration of heavier hydrocarbons. An apparatus 100 configured to perform such operation is schematically shown in FIG. 7. In general, the liquid sample in sample holder 22 is connected to different expansion chambers 110 and 115 successively. After each expansion, the molecules in gas phase in each of the expansion chambers 110 and 115 are isolated, and mole fraction of the compounds are measured by a mass spectrometer 120.

After the first expansion, the first chamber 110 is isolated. The residual liquid is then the new feed material for the second expansion in the second chamber 115. The process can be continued until the components of interest have been totally vaporized. The results of a second expansion on the crude oil sample, where for the second cell the pressure is 14 psia, the temperature is 120° C., and the gas volume is 24.10 cc, are shown below in Table 7.

TABLE 7

| Component | Feed Mole % | Liquid Mole % | Vapor Mole % | # of moles |
|---|---|---|---|---|
| N2 | 0.03 | 0.00 | 0.13 | 9.4E−07 |
| CO2 | 0.08 | 0.00 | 0.41 | 2.9E−06 |
| C1 | 5.48 | 0.09 | 27.50 | 2.0E−04 |
| C2 | 1.98 | 0.10 | 9.65 | 7.0E−05 |
| C3 | 1.97 | 0.21 | 9.15 | 6.6E−05 |
| i-C4 | 0.96 | 0.17 | 4.17 | 3.0E−05 |
| n-C4 | 1.71 | 0.38 | 7.14 | 5.1E−05 |
| i-C5 | 1.00 | 0.36 | 3.64 | 2.6E−05 |
| n-C5 | 1.19 | 0.47 | 4.08 | 2.9E−05 |
| C6 | 2.47 | 1.54 | 6.26 | 4.5E−05 |
| C7 | 5.23 | 4.42 | 8.56 | 6.2E−05 |
| C8 | 8.43 | 8.22 | 9.29 | 6.7E−05 |
| C9 | 6.55 | 7.12 | 4.23 | 3.1E−05 |
| C10 | 5.61 | 6.45 | 2.16 | 1.6E−05 |
| C11 | 8.07 | 9.60 | 1.84 | 1.3E−05 |
| C12 | 6.83 | 8.29 | 0.88 | 6.3E−06 |
| C13 | 7.11 | 8.73 | 0.51 | 3.7E−06 |
| C14 | 6.49 | 8.02 | 0.25 | 1.8E−06 |
| C15 | 3.87 | 4.80 | 0.08 | 5.5E−07 |
| C16 | 3.68 | 4.57 | 0.04 | 2.7E−07 |
| C17 | 2.57 | 3.20 | 0.01 | 9.8E−08 |
| C18 | 1.97 | 2.45 | 0.01 | 4.2E−08 |
| C19 | 1.68 | 2.09 | 0.00 | 2.1E−08 |
| C20 | 15.03 | 18.71 | 0.00 | 5.4E−10 |

The second cell used the residual liquid mole fraction as the new feed mole fraction. A drop in pressure from 324 psia to 14 psia generates a volume of gas of 24.10 cc. From the table, hydrocarbons up to C11 may become measurable by the criterion discussed above. However, although the C5-C11 concentrations are now measured, their concentrations in the first expansion are not known. A method is proposed below to address this problem.

To measure the concentration of C5-C11 in the first expansion, one needs to enhance those concentrations by mixing the gas from the second expansion with some of the gas from the first expansion. Since the second expansion has higher concentration of C5-C11 components, the mixing helps enhance the concentration of at least some components in the range C5-C11 to make them measurable. It should be emphasized that use of C5-C11 is a function of the arbitrarily chosen 1% resolution for the concentration measurement device. These limits will obviously change with the actual resolution of the device that may be more or less accurate.

In the following analysis, we assume the two chambers have the same volume, but the method is not limited to equal volumes. The method works by removing some of the gas in the first chamber 110, which is equivalent to reducing the number of moles of each component by a factor Rd. The two chambers 110, 115 are then connected together allowing the two chambers to come to equilibrium at which time the number of moles of each component is the sum of the moles in each cell. The number of moles of i-C5, for example, in the combined cell (cell'$_2$) comprising the first chamber 110 (cell$_1$) and the second chamber 115 (cell$_2$) is given by:

$$n_{iC5}^{cell'_2} = \frac{n_{iC5}^{cell_1}}{Rd} + n_{iC5}^{cell_2}$$

In this expression, Rd is a design parameter and can be varied to obtain measurable results. The expression can be solved for the number of moles of i-C5 in the first chamber 110 (cell$_1$) as:

$$n_{iC5}^{cell_1} = Rd \cdot (n_{iC5}^{cell'_2} - n_{iC5}^{cell_2})$$

Figure 8:
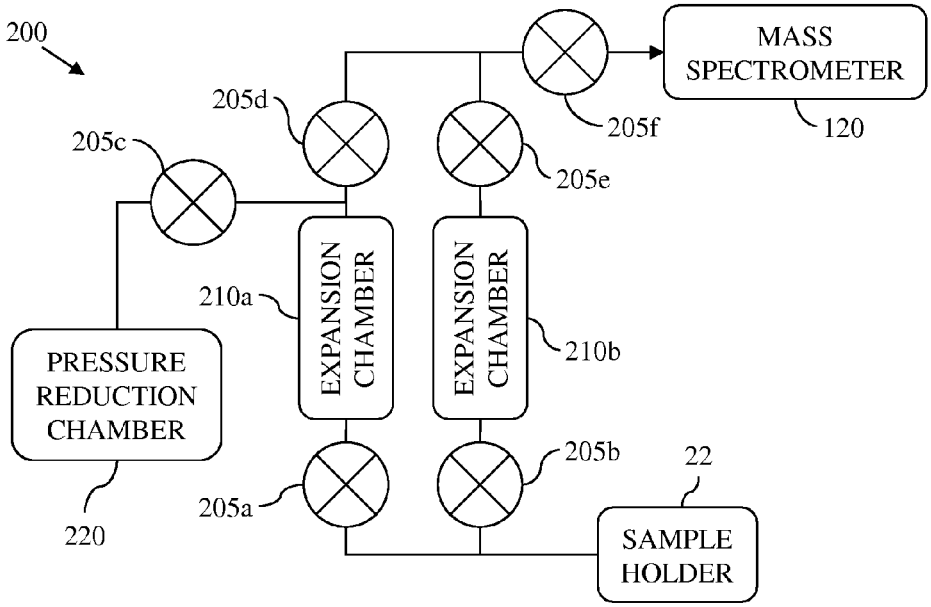
FIG. 8 is a schematic view of at least a portion of an apparatus according to one or more aspects of the present disclosure.

For this method to work, the concentration in the second chamber 115 (cell$_2$) and the combined cell (cell'$_2$) should be measurable and Rd is judicially chosen to achieve that goal. Similar expressions exist for other components. An apparatus 200 for such operation is shown in FIG. 8.

At first, all valves 205*a-f* are closed and all expansion chambers 210*a-b* are evacuated. The first expansion is by opening valve 205*a*. At this point, and for the sample of crude oil used above, in the first configuration, there is a pressure of 324 psia and a volume of 24 cc. Then, valve 205*a* is closed, and the gas composition is measured. This leads to measured concentration for some of the gases in Table 7 above. Next, valve 205*b* is opened, leading to the second expansion mentioned above. The valve 205*b* is then closed, and the gas composition is measured, leading to measured concentration for more gases listed in Table 7 above. At this point, the pressure reduction chamber 220 is still under vacuum, and opening valve 205*c* causes the contents of chamber 210*a* to expand further and lower its pressure by a factor Rd, as required by the expression above. This does not change the relative concentration of gases present, but reduces the number of moles of each component by a factor Rd. As a first approximation, the factor Rd is directly the ratio of the volumes (V1+V2)/V1, where V1 is the volume of chamber 210*a* and V2 is the volume of the pressure reduction chamber 220. The pressure in the combined chamber (V1+V2) becomes:

$$P_2 \cdot (V_1 + V_2) = P_1 \cdot V_1$$

$$P_2 = P_1 \cdot \frac{V_1}{V_1 + V_2} = \frac{P_1}{Rd}$$

The number of moles present in the combined chamber becomes:

$$P_2 \cdot V_1 = n'_1 \cdot R \cdot T = \frac{P_1 \cdot V_1}{Rd} = \frac{n_1 \cdot R \cdot T}{Rd}$$

$$n'_1 = \frac{n_1}{Rd}$$

The results of concentration enhancement are shown below in Table 8. Through this technique, with the arbitrary concentration measurement accuracy mentioned above, it is now possible to determine molar concentrations in the first chamber 210*a* up to C9.

TABLE 8

| Component | Reduction factor K | # of moles (cell' 2) = cell 1/K + cell 2 | Mole in gas (%) |
|---|---|---|---|
| N2 | 10 | 1.603E−05 | 0.67 |
| CO2 | | 1.544E−05 | 0.64 |
| C1 | | 1.516E−03 | 62.92 |
| C2 | | 2.295E−04 | 9.52 |
| C3 | | 1.388E−04 | 5.76 |
| i-C4 | | 5.042E−05 | 2.09 |
| n-C4 | | 8.052E−05 | 3.34 |
| i-C5 | | 3.594E−05 | 1.49 |
| n-C5 | | 3.913E−05 | 1.62 |
| C6 | | 5.518E−05 | 2.29 |
| C7 | | 7.236E−05 | 3.00 |
| C8 | | 7.742E−05 | 3.21 |
| C9 | | 3.501E−05 | 1.45 |
| C10 | | 1.785E−05 | 0.74 |
| C11 | | 1.523E−05 | 0.63 |
| C12 | | 7.295E−06 | 0.30 |
| C13 | | 4.270E−06 | 0.18 |
| C14 | | 2.090E−06 | 0.09 |
| C15 | | 6.411E−07 | 0.03 |
| C16 | | 3.141E−07 | 0.01 |
| C17 | | 1.166E−07 | 0.00 |
| C18 | | 4.967E−08 | 0.00 |
| C19 | | 2.554E−08 | 0.00 |
| C20 | | 6.932E−10 | 0.00 |

The liquid left in the reservoir could go through more expansions as needed. For example, if a third expansion is performed, with pressure at 4.5 psia, temperature at 120° C., and gas volume at 25.00 cc, the results would be as shown below in Table 9. Note that the number of moles has decreased.

TABLE 9

| Component | Feed Mole % | Liquid Mole % | Vapor Mole % | # of moles |
|---|---|---|---|---|
| N2 | 0.00 | 0.00 | 0.00 | 0.0E+00 |
| CO2 | 0.00 | 0.00 | 0.00 | 0.0E+00 |
| C1 | 0.09 | 0.00 | 1.09 | 2.6E−06 |
| C2 | 0.10 | 0.00 | 1.18 | 2.8E−06 |
| C3 | 0.21 | 0.02 | 2.38 | 5.7E−06 |
| i-C4 | 0.17 | 0.02 | 1.81 | 4.3E−06 |
| n-C4 | 0.38 | 0.07 | 3.90 | 9.4E−06 |
| i-C5 | 0.36 | 0.10 | 3.25 | 7.8E−06 |
| n-C5 | 0.47 | 0.15 | 4.04 | 9.7E−06 |
| C6 | 1.54 | 0.80 | 9.91 | 2.4E−05 |
| C7 | 4.42 | 3.15 | 18.68 | 4.5E−05 |
| C8 | 8.22 | 6.85 | 23.63 | 5.7E−05 |
| C9 | 7.12 | 6.68 | 12.08 | 2.9E−05 |
| C10 | 6.45 | 6.44 | 6.55 | 1.6E−05 |
| C11 | 9.60 | 9.94 | 5.78 | 1.4E−05 |
| C12 | 8.29 | 8.78 | 2.81 | 6.8E−06 |
| C13 | 8.73 | 9.36 | 1.66 | 4.0E−06 |
| C14 | 8.02 | 8.66 | 0.81 | 1.9E−06 |
| C15 | 4.80 | 5.20 | 0.25 | 5.9E−07 |
| C16 | 4.57 | 4.97 | 0.12 | 2.9E−07 |
| C17 | 3.20 | 3.48 | 0.04 | 1.1E−07 |
| C18 | 2.45 | 2.67 | 0.02 | 4.5E−08 |
| C19 | 2.09 | 2.27 | 0.01 | 2.3E−08 |
| C20 | 18.71 | 20.37 | 0.00 | 5.7E−10 |

To facilitate the concentration measurement in a sample mixture, it is possible to use a multi-chamber cascade. Initial expansion stages remove mostly the more volatile components. Once these usually dominant components are removed, further expansion stages allow larger, less volatile components to be measured.

Figure 9:
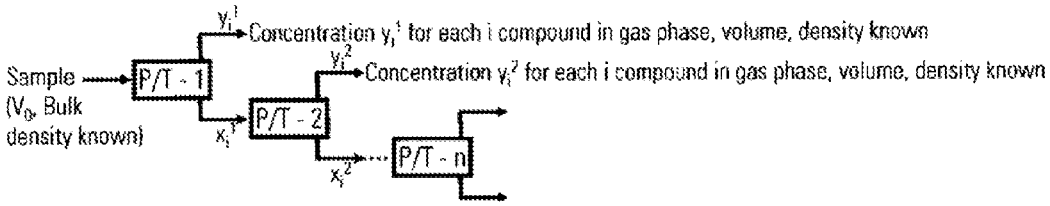
FIG. 9 is a schematic view of at least a portion of an apparatus according to one or more aspects of the present disclosure.

After each expansion, the residual sample left in the sample reservoir has a different composition, and this latter will be the feed for the next vaporization stage. FIG. 9 shows a schematic of the multiple expansion method. The initial sample, for which volume and bulk density are known, is vaporized through a first cell. The gaseous phase is sent to a mass spectrometer for measurement, and the residual liquid phase will be expanded to a second cell. The process can be continued until the components of interest have been totally vaporized.

Figure 10:
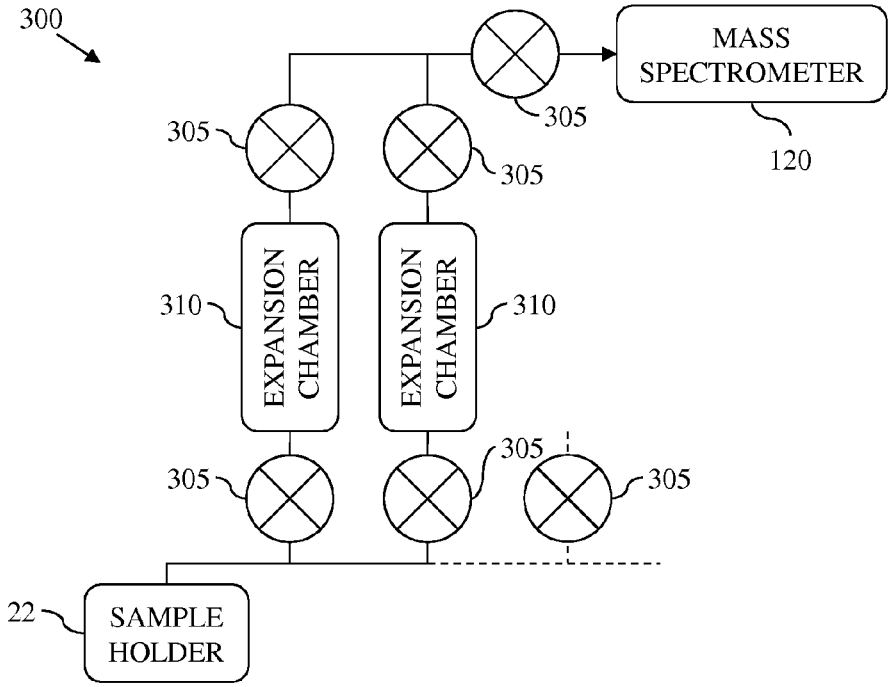
FIG. 10 is a schematic view of at least a portion of an apparatus according to one or more aspects of the present disclosure.

As mentioned above, the set of concentrations from the mass spectrometer together provides the compositional distribution of measurable components in the original feed/liquid sample, truncated to the heaviest (i.e., least volatile) measured component. FIG. 10 shows an apparatus 300 for multi cell expansion. The apparatus has multiple expansion chambers 310 and valves 305 that allow successive expansions to be performed. The liquid in the sample holder 22 is connected to different expansion chambers 310 successively. After each expansion, the gas phase components in each of the expansion chambers 310 are measured using the mass spectrometer 120. The liquid left from each expansion is the feed for the next expansion. The process can be continued until the components of interest have been totally vaporized.

The examples described above mention the use of mass spectrometry as the method of identifying species in the hydrocarbon sample. However, aspects of the present disclosure are applicable or readily adaptable to other types of spectrometry including, without limitation, variations of mass spectrometry (e.g., quadrupole mass spectrometry, time-of-flight mass spectrometry, and/or ion trap mass spectrometry, among others), chromatography, nuclear magnetic resonance (NMR) spectrometry, near infrared spectrometry, infrared spectrometry, Raman spectrometry, ring down spectrometry, laser spectrometry, ion mobility spectrometry, and x-ray spectrometry. Accordingly, the examples described above, as well as other examples within the scope of the present disclosure, are considered applicable to implementations utilizing mass spectrometry and/or other types of spectrometry.

Figure 11A:
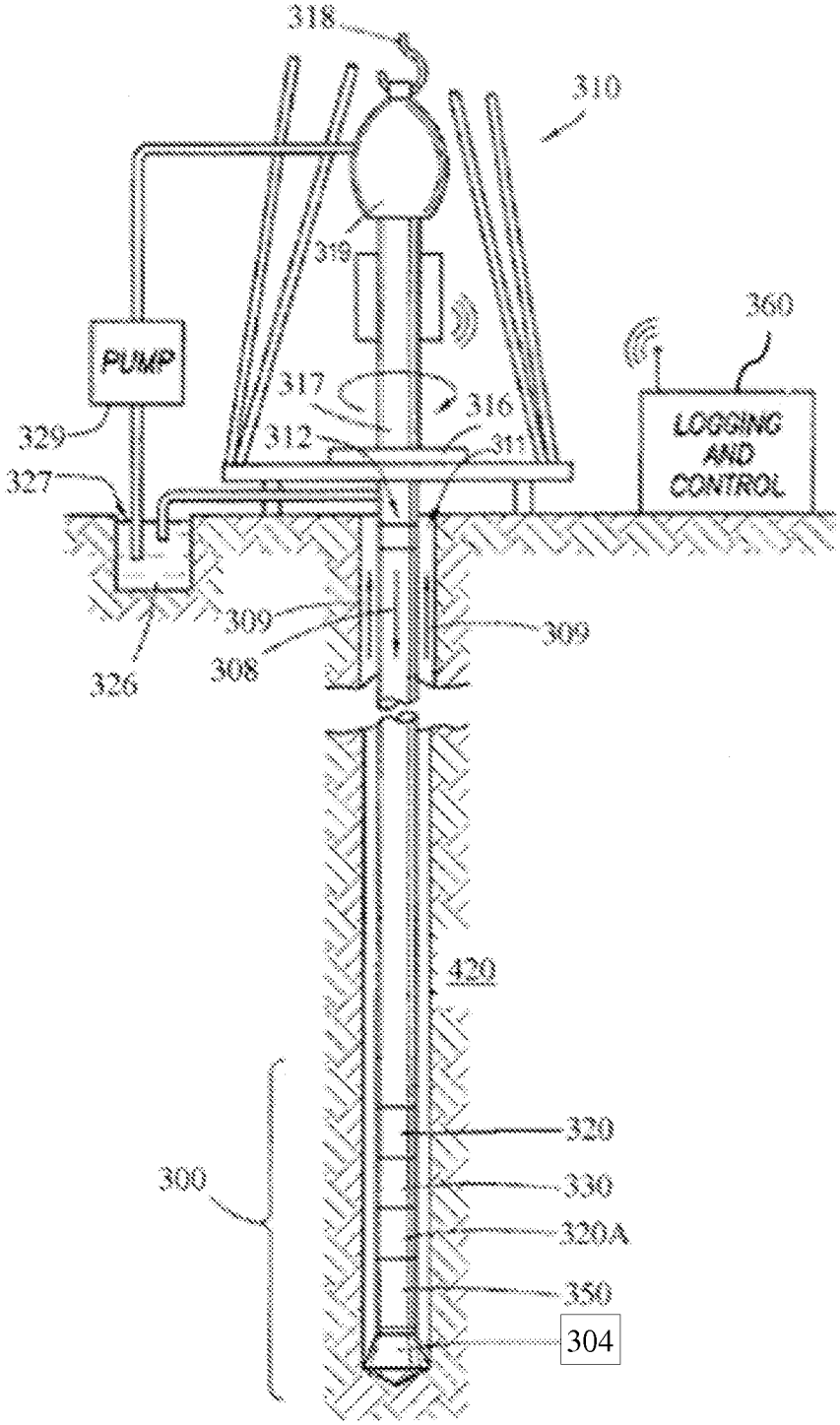
FIG. 11A is a schematic view of at least a portion of an apparatus according to one or more aspects of the present disclosure.

Turning to FIG. 11A, an example well site system according to one or more aspects of the present disclosure is shown. The well site may be situated onshore (as shown) or offshore. The system may comprise one or more while-drilling devices 320, 320A, 330 that may be configured to be positioned in a wellbore 311 penetrating a subsurface formation 420. The wellbore 311 may be drilled through subsurface formations by rotary drilling in a manner that is well known in the art.

A drill string 312 may be suspended within the wellbore 311 and may include a bottom hole assembly (BHA) 300 proximate the lower end thereof. The BHA 300 may include a drill bit 304 at its lower end. It should be noted that in some implementations, the drill bit 304 may be omitted and the bottom hole assembly 300 may be conveyed via tubing or pipe. The surface portion of the well site system may include a platform and derrick assembly 310 positioned over the wellbore 311, the assembly 310 including a rotary table 316, a kelly 317, a hook 318 and a rotary swivel 319. The drill string 312 may be rotated by the rotary table 316, which is itself operated by well known means not shown in the drawing. The rotary table 316 may engage the kelly 317 at the upper end of the drill string 312. As is well known, a top drive system (not shown) could alternatively be used instead of the kelly 317 and rotary table 316 to rotate the drill string 312 from the surface. The drill string 312 may be suspended from the hook 318. The hook 318 may be attached to a traveling block (not shown) through the kelly 317 and the rotary swivel 319, which may permit rotation of the drill string 312 relative to the hook 318.

The surface system may include drilling fluid (or mud) 326 stored in a tank or pit 327 formed at the well site. A pump 329 may deliver the drilling fluid 326 to the interior of the drill string 312 via a port in the swivel 319, causing the drilling fluid 326 to flow downwardly through the drill string 312 as indicated by the directional arrow 308. The drilling fluid 326 may exit the drill string 312 via water courses, nozzles, or jets in the drill bit 304, and then may circulate upwardly through the annulus region between the outside of the drill string and the wall of the wellbore, as indicated by the directional arrows 309. The drilling fluid 326 may lubricate the drill bit 304 and may carry formation cuttings up to the surface, whereupon the drilling fluid 326 may be cleaned and returned to the pit 327 for recirculation.

The bottom hole assembly 300 may include a logging-while-drilling (LWD) module 320, a measuring-while-drilling (MWD) module 330, a rotary-steerable directional drilling system and hydraulically operated motor 350, and the drill bit 304. The LWD module 320 may be housed in a special type of drill collar, as is known in the art, and may contain a plurality of known and/or future-developed types of well logging instruments. It will also be understood that more than one LWD module may be employed, for example, as represented at 320A (references, throughout, to a module at the position of LWD module 320 may alternatively mean a module at the position of LWD module 320A as well). The LWD module 320 may include capabilities for measuring, processing, and storing information, as well as for communicating with the MWD 330. In particular, the LWD module 320 may include a processor configured to implement one or more aspects of the methods described herein. For example, the LWD module 320 may comprise a testing-while-drilling device configured to utilize the above-described aspects of determining the composition of a hydrocarbon downhole, such as may be sampled from a borehole fluid, drilling fluid (mud), formation fluid sampled from the formation 420, and/or others.

The MWD module 330 may also be housed in a special type of drill collar, as is known in the art, and may contain one or more devices for measuring characteristics of the drill string and drill bit. The MWD module 330 may further include an apparatus (not shown) for generating electrical power for the downhole portion of the well site system. Such apparatus typically includes a turbine generator powered by the flow of the drilling fluid 326, it being understood that other power and/or battery systems may be used while remaining within the scope of the present disclosure. In the present example, the MWD module 330 may include one or more of the following types of measuring devices: a weight-on-bit measuring device, a torque measuring device, a vibration measuring device, a shock measuring device, a stick slip measuring device, a direction measuring device, and an inclination measuring device. Optionally, the MWD module 330 may further comprise an annular pressure sensor and/or a natural gamma ray sensor. The MWD module 330 may include capabilities for measuring, processing, and storing information, as well as for communicating with a logging and control unit 360. For example, the MWD module 330 and the logging and control unit 360 may communicate information (uplinks and/or downlinks) via mud pulse telemetry (MPT) and/or wired drill pipe (WDP) telemetry. In some cases, the logging and control unit 30 may include a controller having an interface configured to receive commands from a surface operator. Thus, commands may be sent to one or more components of the BHA 300, such as to the LWD module 320.

Figure 11B:
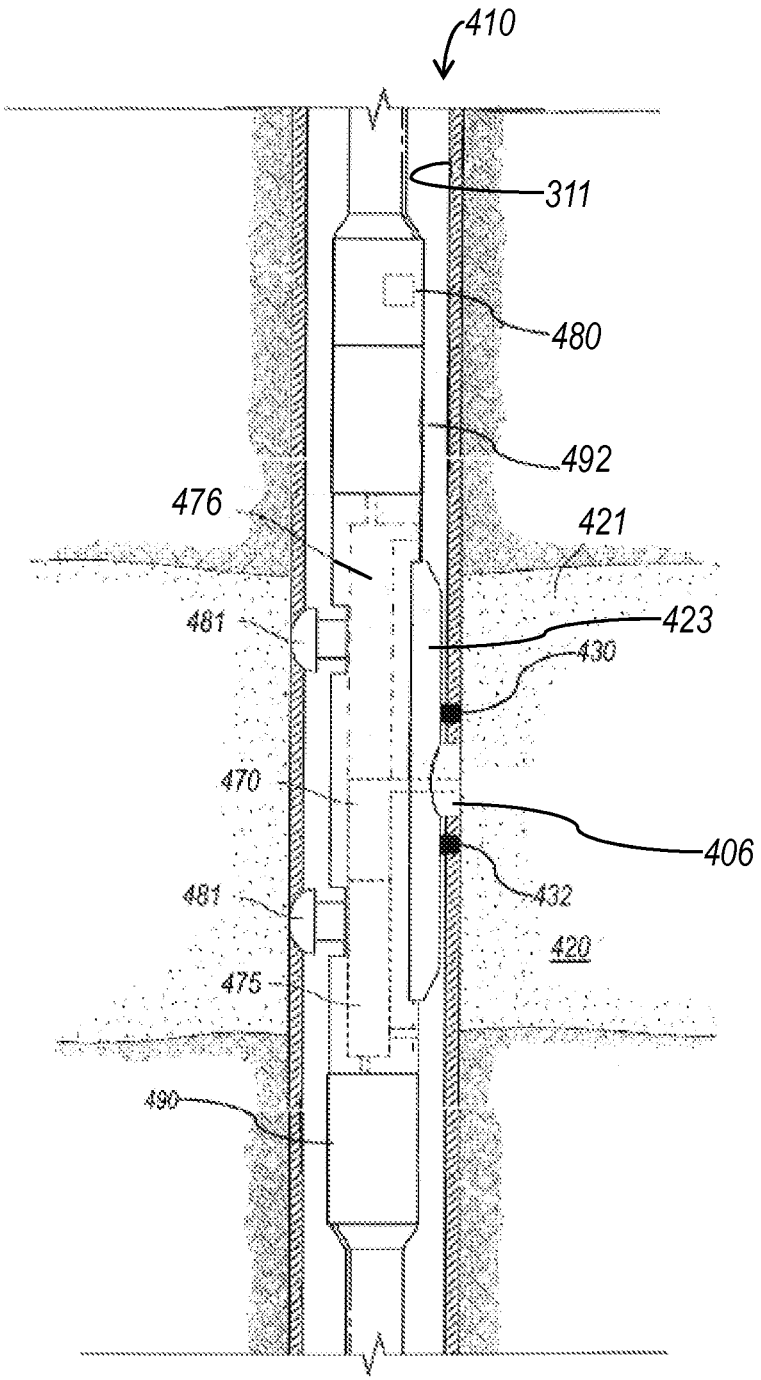
FIG. 11B is a schematic view of at least a portion of an apparatus according to one or more aspects of the present disclosure.

A testing-while-drilling device 410 which may be identical or similar to the LWD tool 320 in FIG. 11A is shown in FIG. 11B. The testing-while-drilling device 410 may be provided with a stabilizer that may include one or more blades 423 configured to engage a wall of the wellbore 311. The testing-while-drilling device 410 may be provided with a plurality of backup pistons 481 configured to assist in applying a force to push and/or move the testing-while-drilling device 410 against the wall of the wellbore 311. The configuration of the blade 423 and/or the backup pistons 481 may be of a type described, for example, in U.S. Pat. No. 7,114,562, incorporated in its entirety herein by reference. However, other types of blade or piston configurations may be used to implement the testing-while-drilling device 410 within the scope of the present disclosure. A probe assembly 406 may be configured to extend from the stabilizer blade 423 of the testing-while-drilling device 410. The probe assembly 406 may be configured to selectively seal off or isolate selected portions of the wall of the wellbore 311 to fluidly couple to the adjacent formation 420. Thus, the probe assembly 406 may be configured to fluidly couple components of the testing-while-drilling device 410, such as pumps 475 and/or 476, to the adjacent formation 420. Once the probe assembly 406 fluidly couples to the adjacent formation 420, various measurements may be conducted on the adjacent formation 420. For example, a pressure parameter may be measured by performing a pretest. Alternatively, or additionally, a sample may be withdrawn from the formation 420 via the probe assembly 406, and this sample may be expanded, perhaps incrementally, as described above, possibly in conjunction with a spectrometry device also positioned within the device 410 and/or other component of the drill string.

The pump 476 may be used to draw subterranean formation fluid 421 from the formation 420 into the testing-while-drilling device 410 via the probe assembly 406. The fluid may thereafter be expelled through a port into the wellbore, or it may be sent to one or more fluid analyzers disposed in a sample analysis module 492, which may receive the formation fluid for subsequent analysis. Such fluid analyzers may, for example, comprise expansion means and spectrometry means for interpreting spectral data therefrom, such as to determine fluid composition utilizing the aspects described above. The sample analysis module 492 may also or alternatively be configured to perform such analysis on fluid obtained from the wellbore and/or drill string. For example, the sample analysis module 492 may be configured for use in mud-gas logging operations, wherein gas extracted from mud before and/or after the bit is expanded and analyzed via spectrometry to determine composition and/or concentrations, as described above.

The stabilizer blade 423 of the testing-while-drilling device 410 may be provided with a plurality of sensors 430, 432 disposed adjacent to a port of the probe assembly 406. The sensors 430, 432 may be configured to determine petrophysical parameters (e.g., saturation levels) of a portion of the formation 420 proximate the probe assembly 406. For example, the sensors 430 and 432 may be configured to measure electric resistivity, dielectric constant, magnetic resonance relaxation time, nuclear radiation, and/or combinations thereof, among others.

The testing-while-drilling device 410 may include a fluid sensing unit 470 through which the obtained fluid samples and/or injected fluids may flow, and which may be configured to measure properties of the flowing fluid. It should be appreciated that the fluid sensing unit 470 may include any combination of conventional and/or future-developed sensors within the scope of the present disclosure.

A downhole control system 480 may be configured to control the operations of the testing-while-drilling device 410. For example, the downhole control system 480 may be configured to control the extraction of fluid samples from the formation 420, wellbore and/or drill string, the expansion and/or analysis thereof, and/or any pumping thereof, for example, via the pumping rate of the pumps 475 and/or 476.

The downhole control system 480 may be further configured to analyze and/or process data obtained from the downhole sensors and/or disposed in the fluid sensing unit 470 or from the sensors 430, and/or the fluid analysis module 492. The downhole control system 480 may be further configured to store measurement and/or processed data, and/or communicate measurement and/or processed data to another component and/or the surface for subsequent analysis.

While the testing-while drilling device 410 is depicted with one probe assembly, multiple probes may be provided with the testing-while drilling device 410 within the scope of the present disclosure. For example, probes of different inlet sizes, shapes (e.g., elongated inlets) or counts, seal shapes or counts, may be provided.

In any of the implementations described above or otherwise within the scope of the present disclosure, liquid samples to be analyzed may be obtained from the formation, from drilling mud travelling down the drill string (for "before the bit" measurements), and/or from drilling mud in the annulus between the drill string and the wellbore wall (for "after the bit" measurements). Such samples may comprise at least one of hydrocarbons, hydrogen sulfide, carbon dioxide, nitrogen, hydrogen and helium, among others. Such samples may be expanded by using the above-described cylinder-piston or fixed volume chambers configurations. A cylinder/piston arrangement as schematically shown in FIG. 1 may be employed to expand the volume incrementally from zero up to a maximum volume. At each incremental volume, a portion of the initial pressurized fluid transforms to gas and exerts a pressure on the piston. As a result, the liquid volume reduces. This or a similar cylinder/piston arrangement may be implemented in one or more of the modules shown in FIGS. 11A and/or 11B to prepare samples for subsequent analysis that utilizes the aspects described above.

Figure 12:
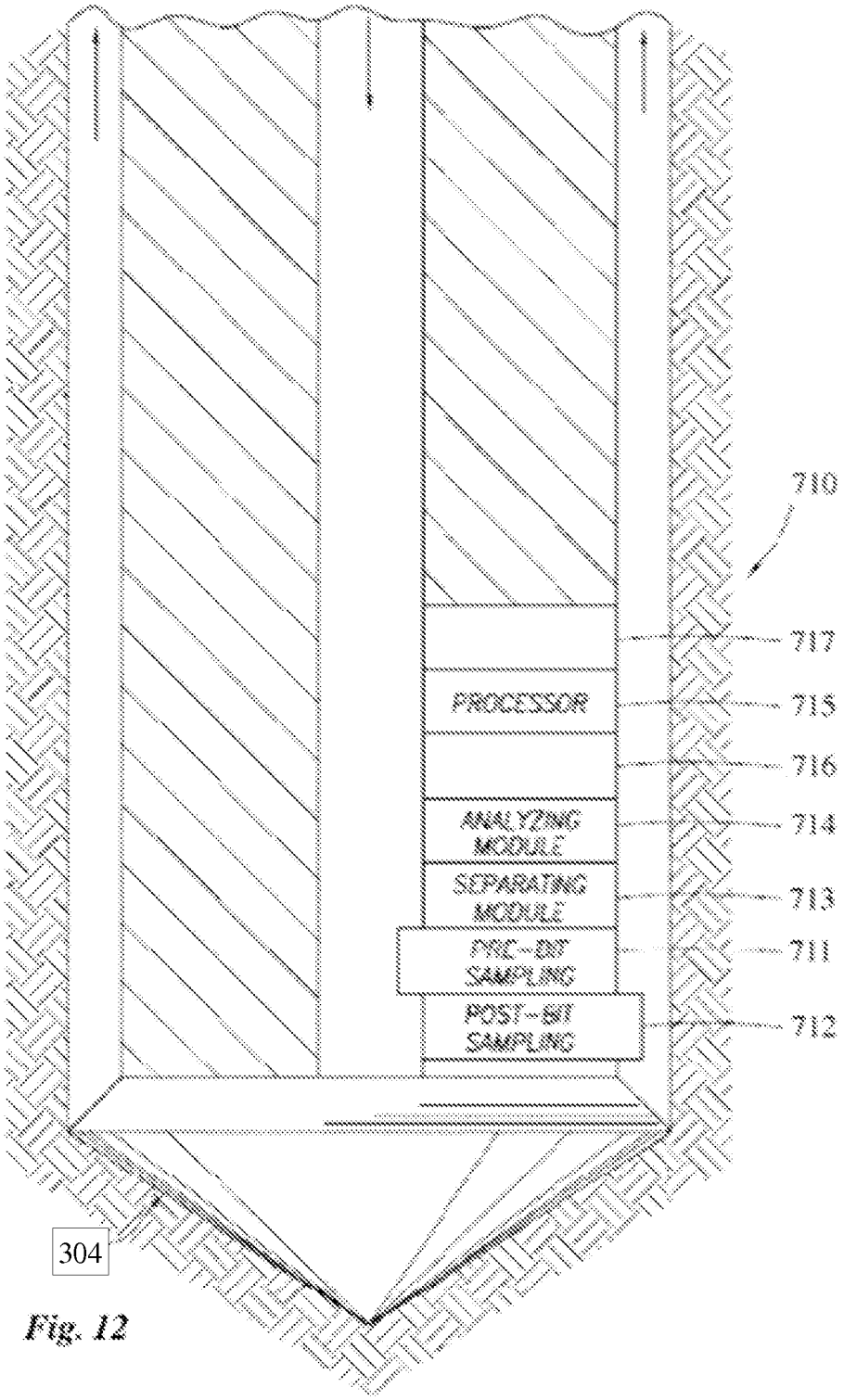
FIG. 12 is a schematic view of at least a portion of an apparatus according to one or more aspects of the present disclosure.

Techniques described herein can be performed using various types of downhole equipment. FIG. 12 shows a diagram of a subsystem 710 according to one or more aspects of the present disclosure. The subsystem 710 may, for example, be at least a portion of one of the modules shown in FIGS. 11A and/or 11B, among others within the scope of the present disclosure. The modules of subsystem 710 may be configured to communicate with each other. The subsystem 710 includes sampling modules 711 and 712. The module 711 samples the mud within the drill collar before it reaches the drill bit 304 to obtain a pre-bit sample, and the module 712 samples the mud, including entrained components, in the annulus after passage through the drill bit 304 to obtain a post-bit sample. It will be understood that the sampling modules 711 and 712 may share at least some components. The subsystem 710 also includes separating and analyzing modules 713 and 714, respectively, and an electronic processor 715, which has associated memory (not separately shown), sample storage and disposition module 716, which can store selected samples and can also expel samples and/or residue to the annulus, and local communication module 717 configured to communicate with one or more other communications components within the drill string. It will be understood that some of the individual modules may be in plural form.

Figure 13:
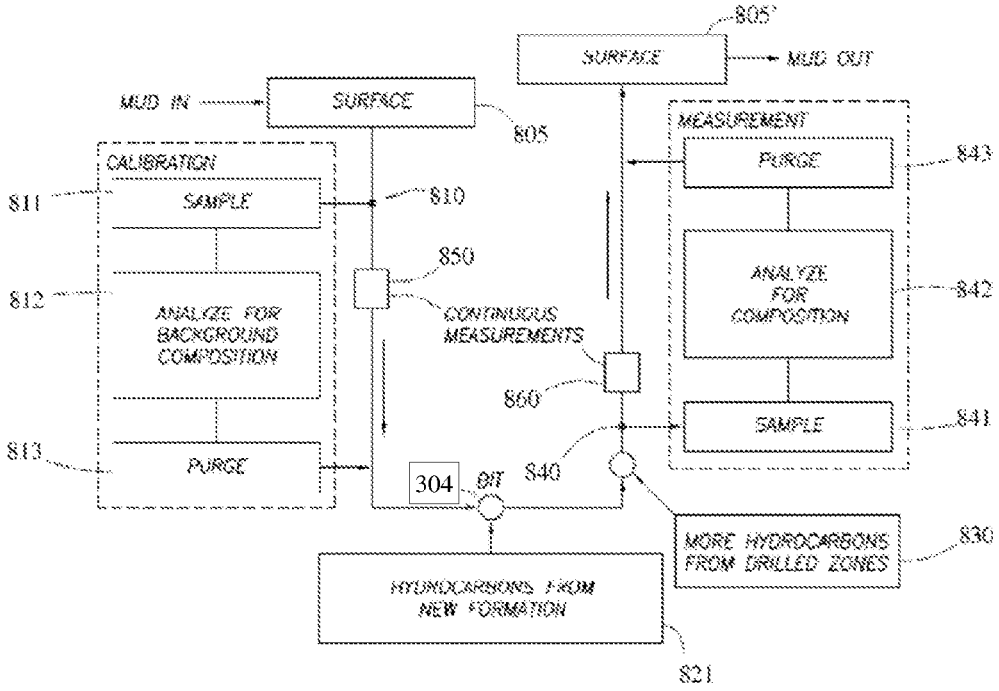
FIG. 13 is a schematic view of at least a portion of a process according to one or more aspects of the present disclosure.

FIG. 13 is a diagram that illustrates a process according to one or more aspects of the present disclosure which may utilize above-described techniques. Drilling mud from a surface location 805 may arrive, after travel through the drill string, at a (pre-bit) calibration measurement location 810, where sampling (block 811), analysis for background composition 812, and purging (block 813) may be implemented. The mud then passes the drill bit 304, and hydrocarbons (as well as other fluids and solids) from a new formation being drilled into (block 821) are mixed with the mud. The mud in the annulus will also contain hydrocarbon and other components from zones already drilled through (block 830). The mud in the annulus may then arrive at (post-bit) measurement location 840, where sampling (block 841), expansion and analysis for composition (block 842) and purging (block 843) may be implemented. The mud in the annulus then returns toward the surface (805'). The processor 715 of FIG. 12 may be configured to determine component concentrations utilizing the above-described aspects of expansion and spectrometry analysis.

Figure 14:
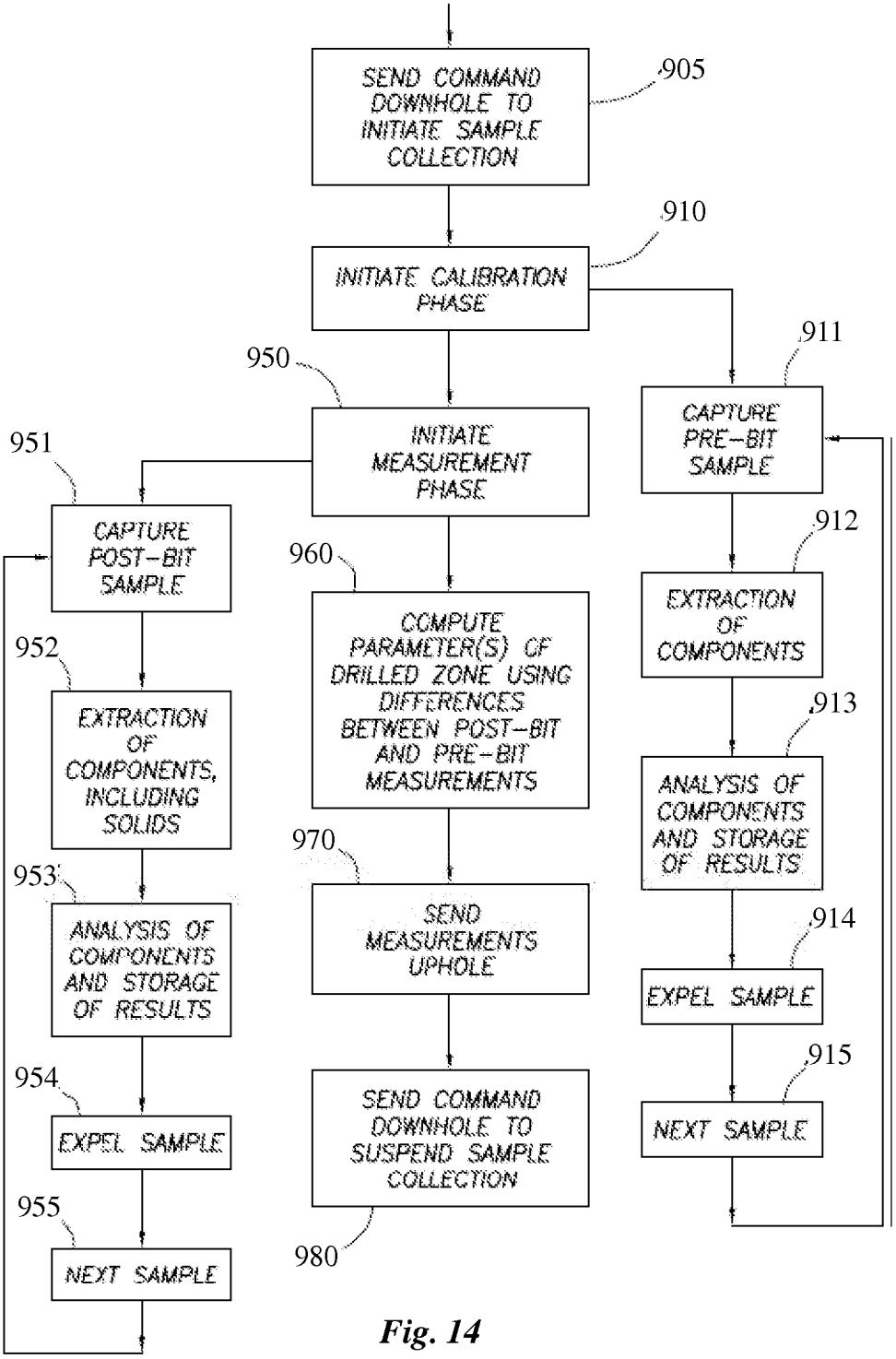
FIG. 14 is a schematic view of at least a portion of a process according to one or more aspects of the present disclosure.

FIG. 14 is a flow diagram of an example routine for controlling the uphole and downhole processors in implementing one or more aspects of the present disclosure. The block 905 represents sending of a command downhole to initiate collection of samples at preselected times and/or depths. A calibration phase is then initiated (block 910), and a measurement phase is also initiated (block 950). The calibration phase includes blocks 910-915.

The block 911 represents capture (by module 711 of FIG. 12) of a sample within the mud flow in the drill collar before it reaches the drill bit. Certain components are extracted from the mud (block 912), and analysis is performed on the pre-bit sample using, for example, the analysis module(s) 713 of FIG. 12, as well as storage of the results as a function of time and/or depth (block 913). The block 914 represents expelling of the sample (although here, as elsewhere, it will be understood that some samples, or constituents thereof, may be retained). Then, if this part of the routine has not been terminated, the next sample (block 915) is processed, beginning with re-entry to block 911.

The measurement phase, post-bit, includes blocks 951-955. The block 951 represents capture (by module 712 of FIG. 12) of a post-bit sample within the annulus, which will include entrained components, matrix rock and fluids, from the drilled zone. The block 952 represents extraction of components, including solids and fluids, and analysis is performed using, for example, the analysis module(s) 713 of FIG. 12, as well as storage of the results as a function of time and/or depth (block 953). The sample can then be expelled (block 954). (Again, if desired, some samples, or constituents thereof, can be retained.) Then, if this part of the routine has not been terminated (e.g., by command from uphole and/or after a predetermined number of samples, an indication based on a certain analysis result, etc.), the next sample (block 955) is processed, beginning with re-entry to block 951.

The block 960 represents optional computation of parameter(s) of the drilled zone using comparisons between the post-bit and pre-bit measurements. The block 970 represents the transmission of measurements uphole. These can be the analysis measurements, computed parameters, and/or any portion or combination thereof. Uphole, the essentially "real time" measurements can, optionally, be compared with surface mud logging measurements or other measurements or databases of known rock and fluid properties (e.g., fluid composition or mass spectra). The block 980 represents the transmission of a command downhole to suspend sample collection until the next collection phase.

Regarding the command to the downhole tool to initiate sampling and analysis, the decision as to when to take a sample, or the frequency of sampling, can be based on various criteria. An example of one such criterion being to downlink to the tool every time a sample is required. Another example being to take a sample based on the reading of some open hole logs, e.g., resistivity, NMR, and/or nuclear logs. Yet another example being to take a sample based on a regular increment or prescribed pattern of measured depths or time.

After the sample is captured, a first extraction step comprises extracting, from the sample, gases which are present, and volatile hydrocarbon components as a gas. When extraction is performed at the surface, a first step may comprise dropping the pressure in the mud return line and flashing the gas into a receptacle, as described above. To improve the extraction of gases, agitators of various forms may be used. For volatile, and not so volatile liquids, steam stills may be employed. To expand the volume of a mud sample captured within a down hole tool, a cylinder and piston device or one or more fixed volume chambers can be used, as described above. After hydrocarbons and other gases have been extracted, the above-described compositional analysis can be performed.

Figure 15:
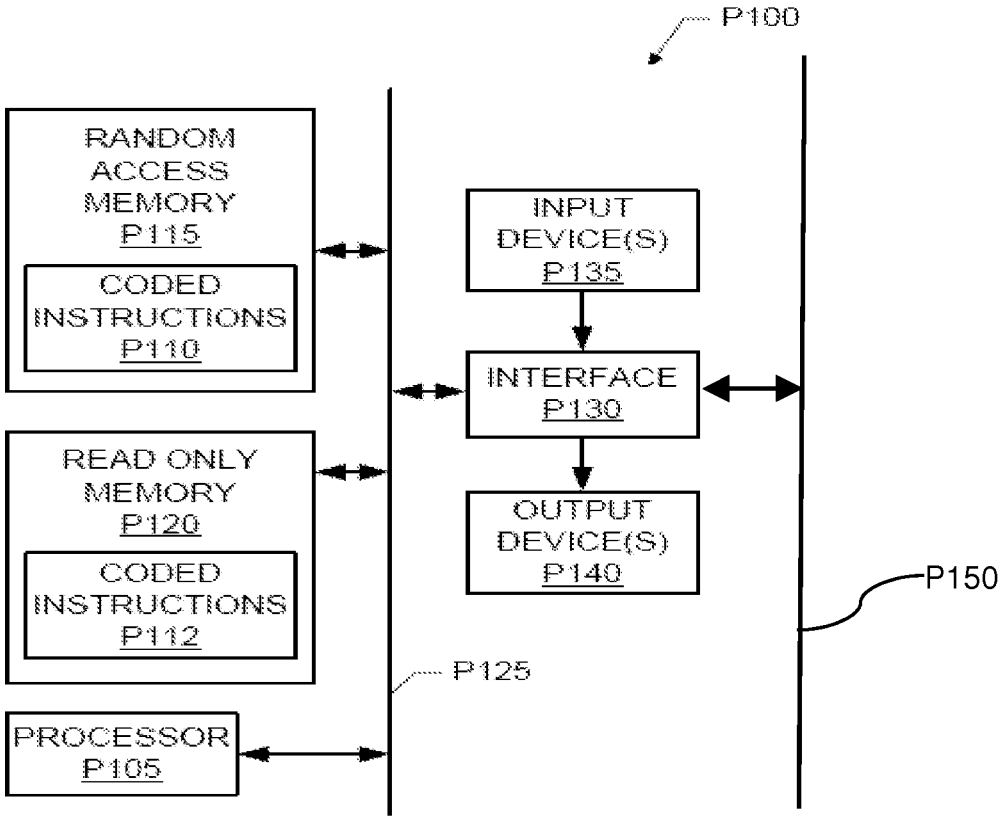
FIG. 15 is a schematic view of at least a portion of an apparatus according to one or more aspects of the present disclosure.

FIG. 15 is a schematic view of at least a portion of an example computing system P100 that may be programmed to carry out all or a portion of the above-described methods of analysis and/or other methods within the scope of the present disclosure. The computing system P100 may be used to implement all or a portion of the electronics, processing and/or control systems and/or components described above, and/or other control means within the scope of the present disclosure. The computing system P100 shown in FIG. 15 may be used to implement surface components (e.g., components located at the Earth's surface) and/or downhole components (e.g., components located in a downhole tool) of a distributed computing system.

The computing system P100 may include at least one general-purpose programmable processor P105. The processor P105 may be any type of processing unit, such as a processor core, a processor, a microcontroller, etc. The processor P105 may execute coded instructions P110 and/or P112 present in main memory of the processor P105 (e.g., within a RAM P115 and/or a ROM P120). When executed, the coded instructions P110 and/or P112 may cause the formation tester or the testing while drilling device to perform at least a portion of the above-described methods, among other operations.

The processor P105 may be in communication with the main memory (including a ROM P120 and/or the RAM P115) via a bus P125. The RAM P115 may be implemented by dynamic random-access memory (DRAM), synchronous dynamic random-access memory (SDRAM), and/or any other type of RAM device, and ROM may be implemented by flash memory and/or any other desired type of memory device. Access to the memory P115 and the memory P120 may be controlled by a memory controller (not shown). The memory P115, P120 may be used to store, for example, measured formation properties (e.g., formation resistivity), petrophysical parameters (e.g., saturation levels, wettability), injection volumes and/or pressures.

The computing system P100 also includes an interface circuit P130. The interface circuit P130 may be implemented by any type of interface standard, such as an external memory interface, serial port, general-purpose input/output, etc. One or more input devices P135 and one or more output devices P140 are connected to the interface circuit P130. The example input device P135 may be used to, for example, collect data from the above-described sensors and/or analyzing devices. The example output device P140 may be used to, for example, display, print and/or store on a removable storage media one or more of measured formation properties (e.g., formation resistivity values or images), petrophysical parameters (e.g., saturation levels or images, wettability), injection volumes and/or pressures. Further, the interface circuit P130 may be connected to a telemetry system P150, including, a multi-conductor cable, mud pulse telemetry (MPT) and/or wired drill pipe (WDP) telemetry. The telemetry system P150 may be used to transmit measurement data, processed data and/or instructions, among other things, between the surface and downhole components of the distributed computing system.

In view of all of the above and the figures, those skilled in the art should readily recognize that the present disclosure introduces an apparatus comprising, in at least one embodiment, a downhole tool configured for conveyance within a wellbore extending into a subterranean formation, the downhole tool comprising a sample holder, an expansion chamber and a spectrometry device, wherein the expansion chamber is in selective fluid communication with the sample holder and the spectrometry device, wherein the expansion chamber is configured to expand a hydrocarbon sample received into the sample holder from a downhole location, and wherein the spectrometry device is configured to analyze the expanded hydrocarbon sample. The expansion chamber may be defined within a cylinder by at least one internal surface of the cylinder and a surface of a piston disposed within the cylinder. The expansion chamber may be a first expansion chamber, and the apparatus may further comprise a second expansion chamber in selective fluid communication with the first expansion chamber and the spectrometry device, wherein the second expansion chamber is configured to further expand a portion of the expanded hydrocarbon sample received from the first expansion chamber, and wherein the spectrometry device is configured to analyze the further expanded portion of the expanded hydrocarbon sample. The apparatus may further comprise a pressure reduction chamber in selective fluid communication with the second expansion chamber. The expansion chamber may be one of a plurality of expansion chambers each in selective fluid communication with the sample holder and the spectrometry device, wherein each of the plurality of expansion chambers is configured to expand a portion of the hydrocarbon sample received from a higher-pressure one of the plurality of expansion chambers. The spectrometry device may comprise at least one of a mass spectrometer, a chromatograph, a nuclear magnetic resonance (NMR) spectrometer, a near infrared spectrometer, an infrared spectrometer, a Raman spectrometer, a ring down spectrometer, a laser spectrometer, an ion mobility spectrometer, or an x-ray spectrometer, among others.

The present disclosure also introduces a method comprising, in at least one embodiment: acquiring a hydrocarbon sample in a downhole tool at a downhole location in a wellbore extending into a subterranean formation; expanding downhole a portion of the hydrocarbon sample; and determining a concentration of a component of the hydrocarbon sample via downhole spectrometry of the expanded portion of the hydrocarbon sample. Expanding downhole the portion of the hydrocarbon sample may comprise allowing the portion of the hydrocarbon sample to expand into an expansion chamber. Expanding downhole the portion of the hydrocarbon sample may comprise incrementally actuating a piston within a cylinder containing the portion of the hydrocarbon sample. The component may be a first component of the hydrocarbon sample, and the method may further comprise: expanding downhole a portion of the expanded portion of the hydrocarbon sample; and determining a concentration of a second component of the hydrocarbon sample via downhole spectrometry of the expanded portion of the expanded portion of the hydrocarbon sample. The method may further comprise: expanding downhole a portion of the expanded portion of the expanded portion of the hydrocarbon sample; and determining a concentration of a third component of the hydrocarbon sample via downhole spectrometry of the expanded portion of the expanded portion of the expanded portion of the hydrocarbon sample. The downhole spectrometry may comprise at least one of mass spectrometry, chromatography, nuclear magnetic resonance (NMR) spectrometry, near infrared spectrometry, infrared spectrometry, Raman spectrometry, ring down spectrometry, laser spectrometry, ion mobility spectrometry, or x-ray spectrometry, among others.

The present disclosure also introduces a method comprising, at least in one embodiment: measuring the composition of a downhole hydrocarbon fluid sample by expanding the sample using an incrementally adjustable piston or a series of fixed chambers to extract vapor containing components of interest. Measuring the composition of the downhole hydrocarbon fluid sample may utilize downhole spectrometry comprising at least one of mass spectrometry, chromatography, nuclear magnetic resonance (NMR) spectrometry, near infrared spectrometry, infrared spectrometry, Raman spectrometry, ring down spectrometry, laser spectrometry, ion mobility spectrometry, or x-ray spectrometry, among others.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A method, comprising:

acquiring a hydrocarbon sample in a downhole tool at a downhole location in a wellbore extending into a subterranean formation, wherein the downhole tool comprises a first chamber, a second chamber, and a spectrometer;

subsequently determining a first characteristic of the hydrocarbon sample by:

expanding the hydrocarbon sample from a first volume to a second volume, wherein the first volume doesn't comprise the first chamber or the second chamber, and wherein the second volume comprises the first chamber but not the second chamber;

subsequently fluidly isolating the first chamber; and subsequently analyzing the hydrocarbon sample in the first chamber using the spectrometer; and subsequently determining a second characteristic of the hydrocarbon sample by:

expanding the hydrocarbon sample portion from the first volume to a third volume, wherein the third volume comprises the second chamber but not the first chamber;

subsequently fluidly isolating the second chamber; and subsequently analyzing the hydrocarbon sample in the second chamber using the spectrometer.

2. The method of claim 1 wherein the acquired hydrocarbon sample is liquid filling the first volume.

3. The method of claim 1 wherein the first characteristic is a first concentration of a first component of the hydrocarbon sample, and wherein the second characteristic is a second concentration of a second component of the hydrocarbon sample.

4. The method of claim 1 wherein analyzing the hydrocarbon sample using the spectrometer comprises measuring a mole fraction of a compound of the hydrocarbon sample.

5. The method of claim 1 wherein:

the first volume of the hydrocarbon sample comprises liquid but not gas;

the second volume of the hydrocarbon sample comprises liquid and gas; and the third volume of the hydrocarbon sample comprises liquid and gas.

6. The method of claim 1 wherein the first and second chambers are substantially equal volumetrically.

7. The method of claim 1 further comprising, after determining the second characteristic:

subsequently determining a third characteristic of the hydrocarbon sample by:

fluidly coupling the first and second chambers together; and subsequently analyzing the hydrocarbon sample in the first and second chambers using the spectrometer.

8. The method of claim 1 further comprising:

determining a third characteristic of the hydrocarbon sample by:

fluidly isolating the first chamber;

subsequently fluidly connecting the first chamber to a third chamber of the downhole tool; and subsequently analyzing the hydrocarbon sample in the first chamber using the spectrometer.

9. The method of claim 1 wherein using the spectrometer comprises using at least one of mass spectrometry, chromatography, nuclear magnetic resonance (NMR) spectrometry, near infrared spectrometry, infrared spectrometry, Raman spectrometry, ring down spectrometry, laser spectrometry, ion mobility spectrometry, and x-ray spectrometry.

10. The method of claim 1 further comprising conveying the downhole tool in the wellbore via wireline.

11. The method of claim 1 further comprising conveying the downhole tool in the wellbore via drill string.

12. A method, comprising:

acquiring a hydrocarbon sample in a downhole tool at a downhole location in a wellbore extending into a subterranean formation, wherein the downhole tool comprises a first chamber, a second chamber, a third chamber, and a spectrometer, and wherein the hydrocarbon sample is liquid having a first volume;

subsequently determining a first concentration of a first component of the hydrocarbon sample by:

expanding the hydrocarbon sample from the first volume to a second volume, wherein the first volume doesn't comprise the first, second, or third chambers, the second volume comprises the first chamber but not the second or third chambers, and the second volume comprises liquid and gas;

subsequently fluidly isolating the first chamber; and subsequently measuring a first mole fraction of the first component of the hydrocarbon sample in the first chamber using the spectrometer;

determining a second concentration of a second component of the hydrocarbon sample by:

fluidly isolating the first chamber;

subsequently fluidly connecting the first chamber to the second chamber; and subsequently measuring a second mole fraction of the second component of the hydrocarbon sample in the first chamber using the spectrometer;

determining a third concentration of a third component of the hydrocarbon sample by:

expanding the hydrocarbon sample portion from the first volume to a third volume, wherein the third volume comprises the third chamber but not the first or second chambers, and wherein the third volume comprises liquid and gas;

subsequently fluidly isolating the third chamber; and subsequently measuring a third mole fraction of the third component of the hydrocarbon sample in the third chamber using the spectrometer; and determining a fourth concentration of a fourth component of the hydrocarbon sample by:

fluidly coupling the first and third chambers together; and subsequently measuring a fourth mole fraction of the fourth component of the hydrocarbon sample in the first and third chambers using the spectrometer.

13. The method of claim 12 wherein:

the first and third chambers are substantially equal volumetrically;

using the spectrometer comprises using at least one of mass spectrometry, chromatography, nuclear magnetic resonance (NMR) spectrometry, near infrared spectrometry, infrared spectrometry, Raman spectrometry, ring down spectrometry, laser spectrometry, ion mobility spectrometry, and x-ray spectrometry; and the method further comprises conveying the downhole tool in the wellbore via at least one of wireline and drill string.

* * * * *